US007217012B2

(12) United States Patent
Southard et al.

(10) Patent No.: US 7,217,012 B2
(45) Date of Patent: May 15, 2007

(54) ILLUMINATED SIGNAGE EMPLOYING LIGHT EMITTING DIODES

(75) Inventors: Paul Southard, Broadview Heights, OH (US); Srinath K. Aanegola, Broadview Heights, OH (US); James T. Petroski, Parma, OH (US); Christopher Bohler, North Royalton, OH (US)

(73) Assignee: Lumination, LLC, Valley View, OH (US)

( * ) Notice: Subject to any disclaimer, the term of this patent is extended or adjusted under 35 U.S.C. 154(b) by 218 days.

(21) Appl. No.: 10/484,674

(22) PCT Filed: May 24, 2002

(86) PCT No.: PCT/US02/16749

§ 371 (c)(1),
(2), (4) Date: Sep. 20, 2004

(87) PCT Pub. No.: WO02/097770

PCT Pub. Date: Dec. 5, 2002

(65) Prior Publication Data

US 2005/0030765 A1 Feb. 10, 2005

(51) Int. Cl.
*F21V 21/00* (2006.01)

(52) U.S. Cl. ..... 362/391; 362/240; 362/249; 362/252; 362/800; 362/812; 439/403; 439/404; 439/419; 439/425

(58) Field of Classification Search ..... 362/240, 362/249, 250, 252, 391, 800, 806–808, 812; 439/403, 404, 417–419, 425
See application file for complete search history.

(56) References Cited

U.S. PATENT DOCUMENTS 671,338 A 4/1901 Halford
3,115,541 A 12/1963 Hanner et al.

(Continued)

FOREIGN PATENT DOCUMENTS

CH 673349 2/1990

(Continued)

OTHER PUBLICATIONS

U.S. Appl. No. 60,200,531, filed Apr. 2000, Honegger et al.

(Continued)

*Primary Examiner*—Stephen F Husar
*Assistant Examiner*—Meghan K. Dunwiddie
(74) *Attorney, Agent, or Firm*—Fay Sharpe LLP

(57) ABSTRACT

An illuminated sign (88) includes a flexible electrical power cord (100) including first and second parallel conductors (112, 114) surroundingly contained within an insulating sheath defining a constant separation distance between the parallel conductors (112, 114). A plurality of light emitting diode (LED) devices (102) are affixed to the cord (100). Each LED device (102) includes an LED (104) having a positive lead (130*p*) electrically communicating with the first parallel conductor (112) and a negative lead (130*p*) electrically communicating with the second parallel conductor (114). A stencil (92) defines a selected shape, and the electrical cord (100) is arranged on the stencil (92). Power conditioning electronics (210, 220) disposed away from the stencil (92) electrically communicate with the first and second parallel conductors (112, 114) of the electrical power cord (100). The power conditioning electronics (210, 220) power the LED devices (102) via the parallel conductors (112, 114).

41 Claims, 12 Drawing Sheets

U.S. PATENT DOCUMENTS

| | | | | |
|---|---|---|---|---|
| 4,173,035 | A | 10/1979 | Hoyt | |
| 4,419,538 | A | 12/1983 | Hansell, III | |
| 4,631,650 | A | 12/1986 | Ahroni | |
| 4,638,117 | A | 1/1987 | Ney | |
| 4,701,991 | A | 10/1987 | Scheffer, Sr. | |
| 4,777,573 | A | 10/1988 | Liao | |
| 4,779,177 | A | 10/1988 | Ahroni | |
| 4,807,098 | A | 2/1989 | Ahroni | |
| 4,813,883 | A | 3/1989 | Staley | |
| 4,815,814 | A | 3/1989 | Ulijasz | |
| 4,855,882 | A | 8/1989 | Boss | |
| 4,899,266 | A | 2/1990 | Ahroni | |
| 4,908,743 | A | 3/1990 | Miller | |
| 4,984,999 | A | 1/1991 | Leake | |
| 4,995,823 | A * | 2/1991 | Morales | 439/226 |
| 5,010,463 | A | 4/1991 | Ross | |
| 5,051,877 | A | 9/1991 | Liao | |
| 5,109,324 | A | 4/1992 | Ahroni | |
| 5,121,310 | A | 6/1992 | Ahroni | |
| 5,141,449 | A | 8/1992 | Tieszen | |
| 5,154,508 | A | 10/1992 | Ahroni | |
| 5,238,424 | A | 8/1993 | Vindum | |
| 5,330,368 | A | 7/1994 | Tsuruzono | |
| 5,337,225 | A | 8/1994 | Brookman | |
| 5,367,122 | A | 11/1994 | de Olano | |
| 5,526,250 | A | 6/1996 | Ting et al. | |
| 5,559,681 | A | 9/1996 | Duarte | |
| 5,584,567 | A | 12/1996 | Rumpel | |
| 5,601,448 | A | 2/1997 | Poon | |
| 5,672,000 | A | 9/1997 | Lin | |
| 5,829,865 | A | 11/1998 | Ahroni | |
| 5,848,837 | A | 12/1998 | Gustafson | |
| 5,934,930 | A | 8/1999 | Camps et al. | |
| 5,967,823 | A | 10/1999 | Tsui | |
| 6,017,241 | A | 1/2000 | Komai | |
| 6,042,248 | A | 3/2000 | Hannah et al. | |
| 6,079,848 | A | 6/2000 | Ahroni | |
| 6,095,847 | A | 8/2000 | Lin | |
| 6,116,944 | A | 9/2000 | Tseng | |
| 6,167,740 | B1 | 1/2001 | Lipari et al. | |
| 6,261,119 | B1 | 7/2001 | Green | |
| 6,283,612 | B1 | 9/2001 | Hunter | |
| 6,290,365 | B1 | 9/2001 | Schlesinger | |
| 6,367,952 | B1 | 4/2002 | Gibboney | |
| 6,371,637 | B1 | 4/2002 | Atchinson et al. | |
| 6,383,013 | B1 | 5/2002 | Ghesla | |
| 6,394,626 | B1 | 5/2002 | McColloch | |
| 6,478,450 | B1 | 11/2002 | Grajcar | |
| 6,505,956 | B1 | 1/2003 | Priddy et al. | |
| 6,566,824 | B2 | 5/2003 | Panagotacos et al. | |
| 6,578,986 | B2 | 6/2003 | Swaris et al. | |
| 6,609,813 | B1 | 8/2003 | Showers et al. | |
| 6,700,136 | B2 | 3/2004 | Guida | |
| 6,712,486 | B1 | 3/2004 | Popovich et al. | |
| 6,846,093 | B2 | 1/2005 | Swaris et al. | |
| 2001/0007526 | A1 * | 7/2001 | Ohkohdo et al. | 362/249 |
| 2004/0032749 | A1 * | 2/2004 | Schindler et al. | 362/555 |

FOREIGN PATENT DOCUMENTS

| | | |
|---|---|---|
| CN | 2160156 Y | 3/1994 |
| CN | 1119722 A | 4/1996 |
| DE | 19829774 | 1/2000 |
| EP | 0331224 | 9/1989 |
| WO | WO 9939319 | 8/1999 |
| WO | WO 0022698 | 4/2000 |
| WO | 1002696 | 5/2000 |
| WO | WO 00/31463 | 6/2000 |

OTHER PUBLICATIONS

U.S. Appl. No. 60/160,480, filed Oct. 1999, Popovich.
U.S. Appl. No. 60/301,951, filed Jun. 2001, Honegger et al.
Lektron, LED Lighting technology, homesite, at http://www.lektroninc.com/products/, pp. 5, last visited Jan. 2002.
Creative World, at http://www.creativemag.com/cwo10100.html, pp. 24, Jan. 2000.
Lumileds Lighting, "Technical Data ChipStrip Lighting," Obsoletes Publication No. DS16, pp. 2-7, May 2001.
Lumileds, "Preliminary Technical Data," Lumileds Lighting Publication No. DS17, pp. 6, 2000.
Lumileds, "LumiLed Line," Lumiled Lighting Publication No. FP02, pp. 4, 2000.
SmartLite Communications, Inc., press release and single-line signs, at http://www.smartlite.com/, pp. 5, 2000.
Chainlight International, at http://www.chainlight.com/, pp. 17, last visited Mar. 2001.

* cited by examiner

ILLUMINATED SIGNAGE EMPLOYING LIGHT EMITTING DIODES

This application claims priority from U.S. Non-provisional patent application Ser. No. 09/866,581 filed on May 25, 2001 now U.S. Pat. No. 6,660,935.

BACKGROUND OF THE INVENTION

Channel letters are known to those skilled in the art of making commercial signs as the most attractive and expensive form of sign lettering. Briefly, channel letters usually include a plastic or metal backing having the shape of the letter to be formed. Metal channel siding, frequently formed of aluminum with a painted or otherwise finished interior and exterior surface, is attached to and sealed to the letter backing, giving depth to the letter to be formed. Electrical lighting fixtures, such as neon tubing and mounting brackets, are attached to the letter backing. Typically, a colored, translucent plastic letter face is attached to the front edge portion of the channel side material.

As discussed above, neon lighting is typically incorporated into channel lettering systems. Neon systems are very fragile and, therefore, tend to fail and/or break during manufacture, shipping or installation. Also, such lighting systems use high voltage (e.g., between about 4,000 and about 15,000 volts) electricity to excite the neon gas within the tubing. High voltage applications have been associated with deaths by electrocution and building damage due to fire. Semiconductor lighting (e.g., light emitting diodes), that overcomes most of these drawbacks, has been used for channel lettering.

One such conventional channel lettering device attaches a light emitting diode ("LED") system to a back of a channel letter such that the LED system emits light toward a translucent face at a front of the device. The LEDs are spaced at regular intervals (e.g., 2 inches) and are pressed into a socket. The socket is designed for a press-fit of a modified Super Flux (Piranha) package. The lead frames of the Piranha are bent 90 degrees to fit into the socket. The connection for the LED is similar to insulation displacement ("IDC"). The socket also has two IDC places for a red and black wire. This system puts all of the LEDs in parallel. Furthermore, the two part power supply (Initial (120VAC to 24VDC) and the Secondary (24VDC to ~2.3VDC)) have two basic wiring connections. The secondary has a sense circuit, which has one LED attached for determining the voltage applied to the rest of the LEDs that are attached to the second connection.

Another conventional channel lettering device attaches to a side of the channel letter and is pointed toward the backing. The diffuse surface of the channel letter walls provides a uniform appearance. Each module has a predetermined number of LEDs electrically connected in series. Furthermore, all of the modules are daisy chained together in a parallel circuit. The LEDs are mounted on an aluminum base for heat sinking purposes.

Another conventional channel lettering device uses a plurality of surface mounted LEDs with an integral connector system.

Although these conventional LED channel lettering systems overcome some of the drawbacks associated with neon systems, other shortcomings are evident. For example, the conventional LED channel lettering systems offer only limited flexibility. More specifically, the LEDs cannot be easily set into a desired shape involving significant curves or bends (e.g., wrapped around a pole or in a very small radius (<3 inches). Furthermore, the LEDs cannot be easily moved from one lighting application to another.

The present invention contemplates an improved apparatus and method that overcomes the above-mentioned limitations and others.

BRIEF SUMMARY OF THE INVENTION

In accordance with one embodiment of the present invention, an illuminated sign is disclosed. A flexible electrical power cord includes first and second parallel conductors surroundingly contained within an insulating sheath defining a constant separation distance between the parallel conductors. A plurality of light emitting diode (LED) devices are affixed to the cord. Each LED device includes an LED having a positive lead electrically communicating with the first parallel conductor and a negative lead electrically communicating with the second parallel conductor. A stencil defines a selected shape and onto which the electrical cord is arranged. Power conditioning electronics disposed away from the stencil electrically communicate with the first and second parallel conductors of the electrical power cord. The power conditioning electronics power the LED devices via the parallel conductors.

In accordance with another embodiment of the present invention, an article of manufacture is disclosed for installing a plurality of light emitting diodes (LEDs) into a channel letter housing which has at least one light-transmissive surface. A substantially rigid structure is pre-formed or formable for arrangement in the channel letter housing. A flexible cable including at least two flexible parallel conductors is arranged to support an electrical potential difference between the parallel conductors. A plurality of LEDs electrically parallel-interconnected by communication of the anode and cathode of each LED with the at least two conductors of the flexible cable. A fastener secures at least a portion of the flexible cable onto the rigid structure. A power module receives power having first characteristics and converts the received power to a supply power having second characteristics which is communicated to the at least two conductors of the flexible cable to power the plurality of parallel-interconnected LEDs.

In accordance with another embodiment of the present invention, a light emitting diode (LED) light engine is disclosed. An electrical cable includes at least two flexible electrical conductors. The electrical cable further includes a flexible, electrically insulating covering that surrounds the electrical conductors. The conductors are arranged substantially parallel with a selected separation therebetween. An LED with a plurality of electrical leads separated by the selected separation electrically contacts the electrical conductors and mechanically pierces the insulating covering to mechanically secure the LED to the electrical cable.

In accordance with another embodiment of the present invention, a light emitting diode (LED) light engine is disclosed. An electrical cable includes a positive flexible conductor connected with an associated positive source of electrical power, a negative flexible conductor connected with an associated negative source of electrical power, and an electrically insulating covering surrounding and electrically insulating the positive and negative conductors and holding the conductors separate at a selected separation distance. An LED includes positive and negative leads. A connector mechanically secures to the flexible insulating covering. The connector includes positive and negative prongs that pierce the insulating covering and electrically contact the positive and negative conductors, respectively.

The connector further has the LED mounted thereon with the positive and negative leads of the LED electrically contacting the positive and negative prongs, respectively.

In accordance with another embodiment of the present invention, a method of manufacturing an LED light engine is provided. A plurality of conductive elements are insulated to form a flexible electrically insulating conductor. An LED is mechanically secured to the insulated conductive elements. Simultaneously with the mechanical securing, a plurality of leads of the LED are electrically contacted to respective ones of the conductive elements.

In accordance with yet another embodiment of the present invention, a flexible lighting device is disclosed. A flexible cable includes an electrically insulating sheath which contains positive and negative conductors electrically isolated from one another. The sheath provides a spacing between the positive and negative conductors. A plurality of light emitting diode (LED) devices are spaced apart from one another on the cable. Each of the LED devices has an LED including positive and negative leads mounted on a connector which mechanically secures the LED device to a portion of the flexible cable and electrically connects the positive and negative LED leads to the positive and negative conductors through positive and negative conductive piercing members which pierce the sheath to make electrical contact with the respective conductors.

In accordance with still yet another embodiment of the present invention, a light emitting diode (LED) lighting apparatus is disclosed. A flexible electrical cable includes an anode wire and a cathode wire arranged in an electrically isolating sheath. A plurality of LED devices are spaced apart along the cable and mechanically and electrically connect therewith. Each LED device includes an LED having at least one anode lead and at least one cathode lead. Each LED device further includes a connector with an LED socket that receives the anode and cathode leads. The LED socket mechanically retains the LED. The connector further includes a first electrically conductive path between the anode lead and the anode wire, and a second electrically conductive path between the cathode lead and the cathode wire. The first and second conductive paths displace portions of the cable sheath.

One advantage of the present invention resides in providing a channel lettering having a reduced number of parts compared with past systems.

Another advantage of the present invention resides in the use of parallel interconnection of the LEDs which reduces the likelihood that a failed LED will adversely affect performance of other LEDs on the same electrical circuit.

Another advantage of the present invention resides in the locating of the conditioning electronics away from the channel lettering, e.g. in a secure and weatherproofed interior location.

Another advantage of the present invention is the avoidance of soldering connections in the flexible LED light engine.

Yet another advantage of the present invention is that it allows for coupling in the electrical power anywhere along the flexible LED light engine.

Still yet another advantage of the present invention resides in its modular nature which allows part or all of a channel lettering to be constructed on-site in a customized manner.

Numerous advantages and benefits of the present invention will become apparent to those of ordinary skill in the art upon reading and understanding the following detailed description.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE INVENTION

Figure 1:
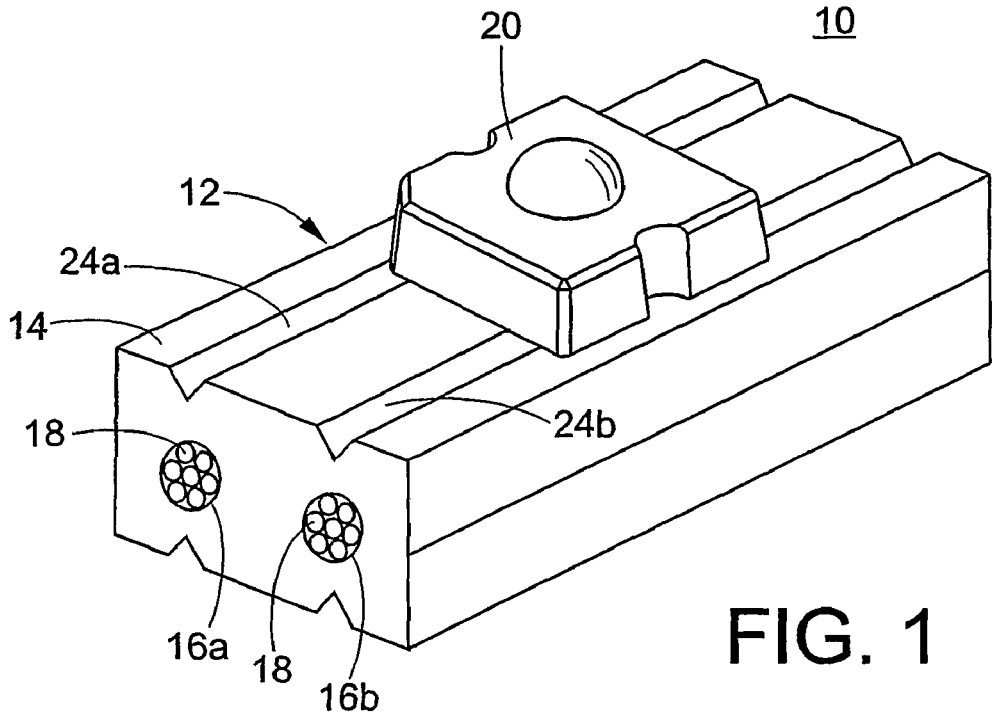
FIG. 1 illustrates an LED light engine according to a first embodiment of the present invention.

With reference to FIG. 1, a light emitting diode (LED) light engine 10 includes a flexible electrical conductor 12 surrounded by a flexible, electrically insulating covering 14. More specifically, the conductor 12 includes a plurality of substantially parallel conductive elements 16, each of which is electrically insulated by the insulating covering 14. In the preferred embodiment, the insulating covering 14 includes rubber, PVC, silicone, and/or EPDM. However, other material are also contemplated.

Preferably, the conductor 12 includes two conductive elements 16*a*, 16*b*. Furthermore, each of the conductive elements 16*a*, 16*b* is preferably sized to be about 14 gauge. Additionally, each of the conductive elements 16*a*, 16*b* is preferably stranded and includes a plurality of strands 18 (e.g., seven strands).

The LED light engine 10 also includes an LED 20, which electrically contacts the conductive elements 16 and is mechanically secured to the insulating covering 14. More specifically, with reference to FIG. 2, the LED 20 includes a plurality of electrical leads 22 (e.g., one pair or two pairs of the leads 22). Although only one pair of the leads 22*a*, 22*b* is necessary, additional pairs of the leads 22*c*, 22*d* offer added stability to the LED 20 mounted on the conductor. Also, additional pairs of the leads 22 provide means for dissipating heat, thereby permitting more current to be used for powering the LED 20. Each of the pairs of leads 22 includes a first lead 22*a*, 22*d*, which connects, for example, to a negative electrical power source and a second lead 22*b*, 22*c*, which connects, for example, to a positive electrical power source. The LED 20 typically a two-terminal device having an anode and a cathode. In a suitable embodiment, the first lead 22*a*, 22*d* corresponds to the anode of the LED 20 and directly electrically connects to the conductive element 16*a*, and the second lead 22*b*, 22*c* corresponds to the cathode of the LED 20 and directly electrically connects to conductive element 16*b*.

Figure 2:
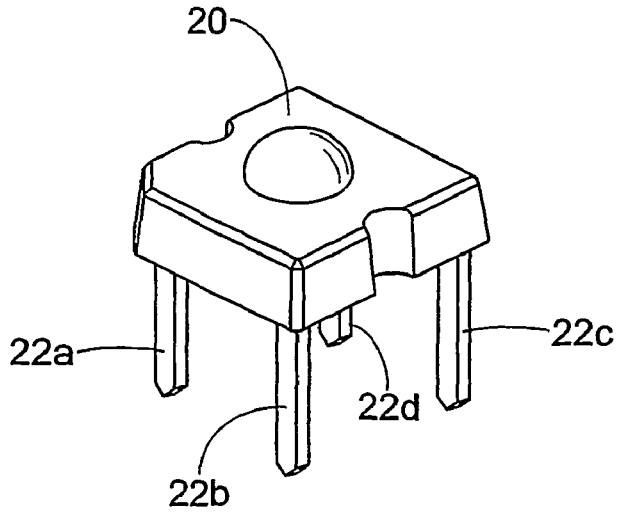
FIG. 2 illustrates a perspective view of the LED shown in FIG. 1.

With reference to FIGS. 1 and 2, the LED 20 is mechanically and electrically secured to the conductor 12 by passing the leads 22 through the insulating covering 14 via an insulation displacement technique. Furthermore, after passing through the insulating covering 14, the leads 22 contact the respective conductive elements 16. Preferably, the leads 22 include tips that are wedge-shaped needles. The wedge-shaped needle tips of the leads 22 pass between the strands 18 of the respective conductive elements 16*a*, 16*b* to form electrical contacts between the leads 22 and the conductive elements 16.

Preferably, the LED 20 is secured to the conductor 12 when the conductor 12 is positioned flat (i.e., when the conductive elements 16*a*, 16*b* run in a common substantially horizontal plane which is above a horizontal surface).

Optionally, the conductor 12 includes two dips (grooves) 24*a*, 24*b* in the insulating covering 14. The dips 24*a*, 24*b* are positioned substantially above the respective conductive elements 16*a*, 16*b*, respectively. Before the LED 20 is secured to the conductor 12, the leads 22 are placed in the dips 24*a*, 24*b* and, therefore, aligned over the conductive elements 16*a*, 16*b*, respectively. Then, after being aligned in the dips 24, the leads 22 are passed through the insulating covering 14 and inserted into the conductive elements 16.

Figure 3:
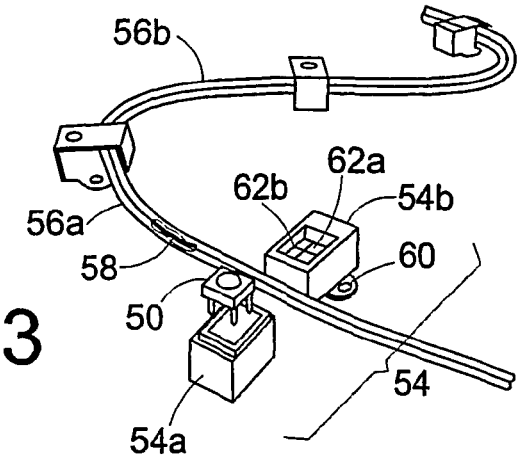
FIG. 3 illustrates an exploded view of an LED connector within a light engine according to a second embodiment of the present invention.
Figure 4:
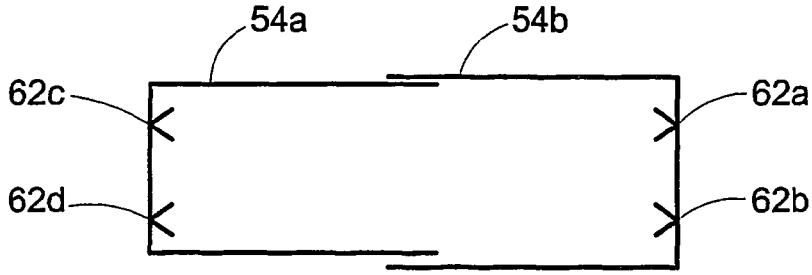
FIG. 4 illustrates a cross-sectional view of the connector of the second embodiment.

With reference to FIGS. 3 and 4, an alternate embodiment which includes a light engine 40 that secures an LED 50 to a conductor 52 via a connector 54 is illustrated. The connector 54 includes first and second sections 54*a*, 54*b*. The LED 50 is secured within the first section 54*a* before both of the sections 54*a*, 54*b* are secured (e.g., snapped or clamped) together. As in the first embodiment, the conductor 52 is flexible and includes a plurality of conductive elements 56*a*, 56*b* (e.g., two conductive elements) and an insulative covering electrically isolating each of the conductive elements 56*a*, 56*b*. Furthermore, the conductive elements 56*a*, 56*b* are optionally stranded and include, for example, seven strands 58.

Optionally, a hole 60 is formed in one of the sections 54*b* through which a means for securing (e.g., a fastener such as a screw, nail, bolt, etc.) is inserted for securing the connector 54 to a wall or other support means. For example, the connector 54 may be secured to a wall of a channel lettering housing (see FIG. 7).

The connector section 54*b* includes a plurality of electrical contacts 62 that, once the sections 54*a*, 54*b* are snapped together, electrically contact the LED 50. As is discussed below, the contacts 62, along with the sections 54*a*, 54*b*, are used for mechanically securing the connector 54 to the conductor 52. A plurality of pairs of the contacts 62 electrically communicate with each other. More specifically, the contacts 62*a*, 62*c* electrically communicate with each other while the contacts 62*b*, 62*d* electrically communicate with each other. In a suitable embodiment, the electrical communication is a direct electrical contacting, i.e. the contacts 62*a*, 62*c* are electrically continuous and the contacts 62*b*, 62*d* are electrically continuous.

One set of the contacts 62*a*, 62*c*, for example, is electrically connected to a positive source of electrical power while the other set of the contacts 62*b*, 62*d*, for example, is electrically connected to a negative source of the electrical power. In this manner, the anode of the LED 50 is in direct electrical contact with the positive source while the cathode of the LED 50 is in direct electrical contact with the negative source of electrical power. The set of contacts 62*a*, 62*c* is electrically isolated from the set of contacts 62*b*, 62*d*. Furthermore, the electrical contacts 62 are V-shaped and sized to accept conductive elements 56*a*, 56*b* within the respective V-shaped spaces. More specifically, the tips of the V-shaped electrical contacts 62 are sharp and formed for displacing (piercing) the insulative coverings around the conductive elements 56*a*, 56*b*.

Although only two of the contacts 62*a*, 62*b* (or, alternatively, 62*c*, 62*d*) is necessary, the connector 54 preferably includes two pairs of the contacts 62 to offer added stability to the mechanical connection between the connector 54 and the conductor 52.

After displacing the insulative coverings, the conductive elements 56*a*, 56*b* are passed into the V-shaped spaces of the electrical contacts 62. As the conductive elements 56*a*, 56*b* are passed into the V-shaped spaces, the strands within the conductive elements 56 are wedged into the vertex of the "V." In this manner, a secure electrical contact is made between the conductive elements 56 and the respective electrical contacts 62. Furthermore, the strands are squeezed such that a shape of the conductor changes, for example, from round to oval. Also, as the strands are squeezed, spaces between the strands is reduced such that an overall size (e.g., diameter or circumference) of the respective conductive element 56*a*, 56*b* is reduced, for example, to a size of an "un-squeezed" three strand connector.

Preferably, the connector 54 is secured to the conductor 52 when the conductor 52 is positioned on-edge (i.e., when the conductive elements 56*a*, 56*b* run in substantially parallel horizontal planes above a substantially horizontal surface).

It is to be understood that although the embodiments have been described with reference to a single LED 20 (FIG. 1) and a single LED connector 54 (FIG. 3) on the conductors 12, 52, respectively, a plurality of LEDs 20 (FIG. 1) and LED connectors 54 (FIG. 3) on the conductors 12, 52, respectively, are contemplated so that the light engines 10, 40 form respective LED strips. Furthermore, the LEDs 20 (FIG. 1) and LED connectors 54 (FIG. 3) on the conductors 12, 52 of the respective LED light strips 10, 40 are preferably spaced about two inches apart from each other. However, other spacings between the LEDs 20 and the LED connectors 54 are also contemplated.

Furthermore, if a plurality of the LEDs 20 are secured to the conductor 12 (FIG. 1), which is oriented in a flat position, the conductor 12 is flexible in a first direction. However, if a plurality of the connectors 54 are secured to the conductor 52 (FIG. 3), which is oriented in an on-edge position, the conductor 52 is flexible in a second direction.

Figure 5:
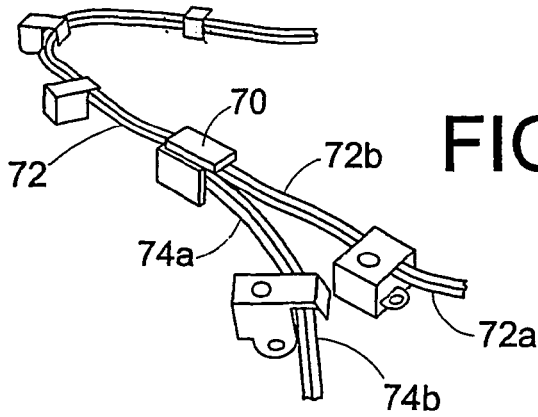
FIG. 5 illustrates a splice connector according to the present invention.
Figure 6:
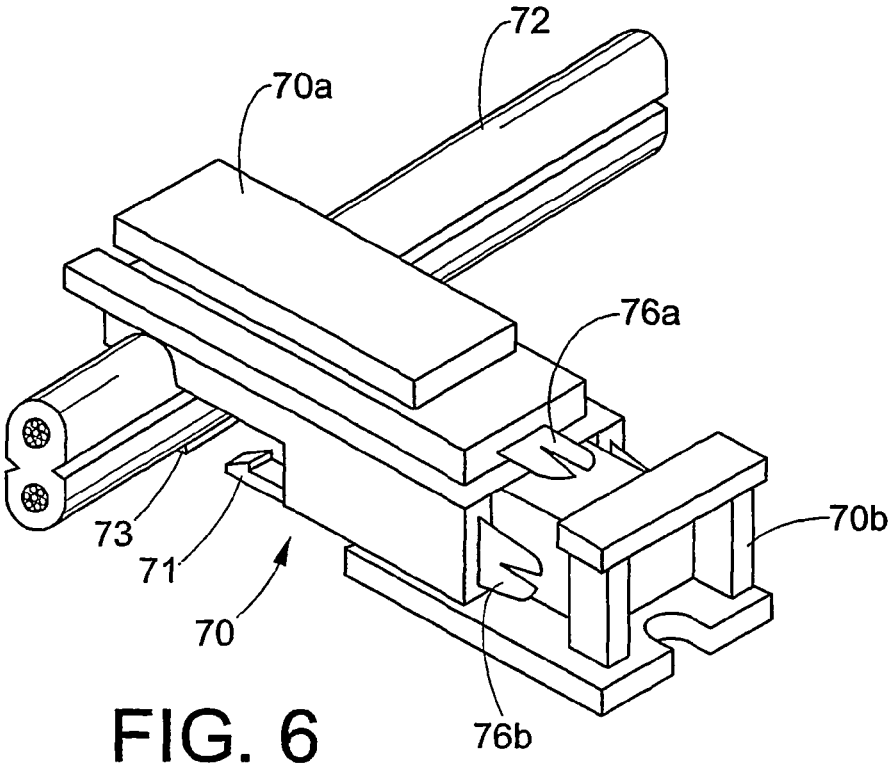
FIG. 6 illustrates an exploded view of the splice connector shown in FIG. 5.

With reference to FIGS. 5 and 6, a splice connector 70 mechanically and electrically connects a plurality of flexible conductors (e.g., two conductors) 72, 74 together. Like the connector 54 (see FIG. 3), the splice connector 70 includes a plurality of portions (e.g., two portions) 70*a*, 70*b*. Preferably, the portions 70*a*, 70*b* are slidably interconnected to each other. Furthermore, the portions 70*a*, 70*b* slide between two positions (e.g., an open position and a closed position). In the closed position, the portions 70*a*, 70*b* are secured together via locking tabs 71, which engage mating tabs 73. Although only one locking tab 71 and one mating tab 73 is shown in FIG. 6, it is to be understood that additional locking and mating tabs are also contemplated. Furthermore, like the conductor 52 and the connector 54 of FIG. 3, the splice connector 70 of FIGS. 5 and 6 is preferably secured to the conductors 72 (shown), 74 (not shown) when the conductors 72, 74 are oriented in an on-edge position. Also, the splice connector 70 includes a plurality of electrical contacts 76 (e.g., two electrical contacts), which are preferably V-shaped and function in a similar manner to the contacts 62 shown in FIG. 4. In the closed position, the locking tabs 71 are secured by the mating tabs 73 such that the conductors 72, 74 are secured within the V-shaped contacts 76.

The conductors 72, 74 are aligned parallel and on-edge with respect to one another. Then, the splice connector 70 is secured around both of the conductors 72, 74. In this manner, respective first conductive elements 72*a*, 74*a* are mechanically and electrically secured to one another; similarly, respective second conductive elements 72*b*, 74*b* are mechanically and electrically secured to one another.

Figure 7:
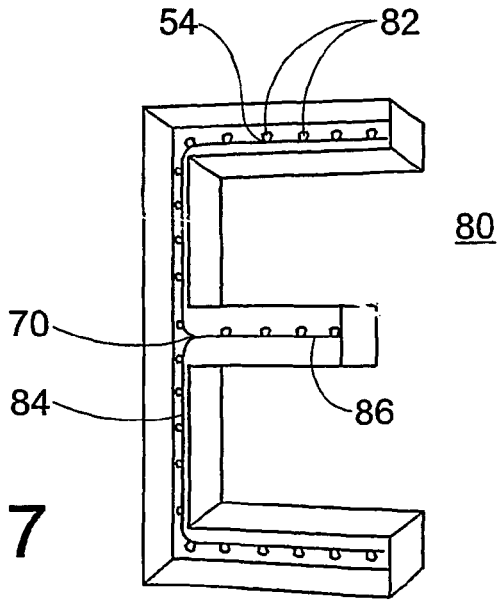
FIG. 7 illustrates the light engine and the splice connector of the present invention used within a channel lettering system.

With respect to FIG. 7, a channel lettering system 80 includes LEDs 82 mechanically and electrically connected to flexible conductors 84 according to the present invention. It is to be understood that the LEDs 82 are either directly connected to the conductors 84 (as shown in FIG. 1) or connected to the conductors 84 via connectors 54 (as shown in FIG. 3). Furthermore, the splice connector 70 is shown mechanically and electrically connecting the conductor 84 to an additional conductor 86.

Figure 8:
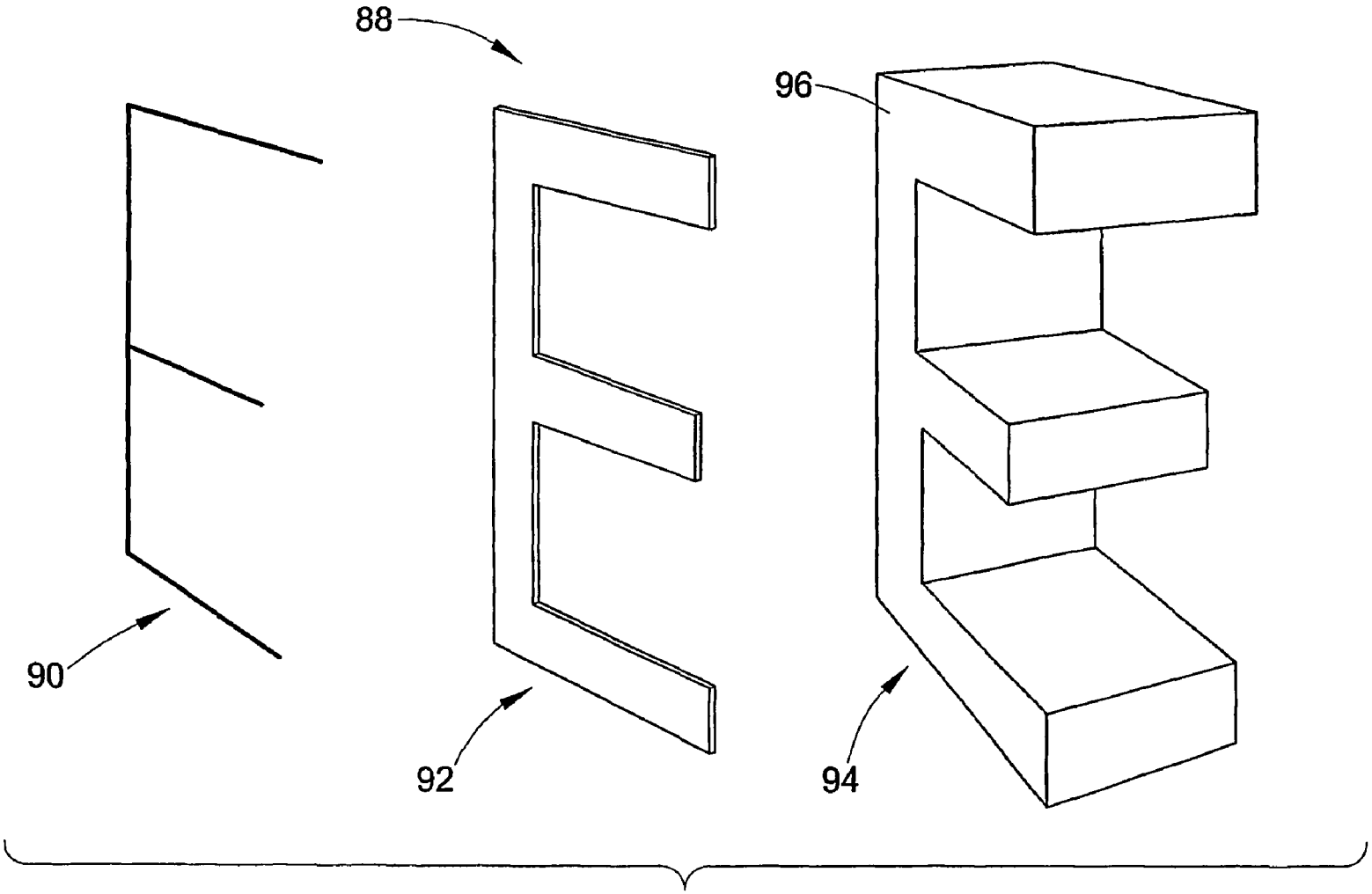
FIG. 8 illustrates an exploded perspective view of a suitable embodiment of a channel lettering system incorporating an intermediate stencil.

With reference to FIGS. 8–16, yet another suitable embodiment of an illuminated sign or channel lettering 88 is described. As shown in FIG. 8, a flexible light engine 90 is mounted on a stencil 92 which defines a selected shape, e.g. the capital letter "E", which conforms with a housing 94 also conforming to the letter "E" and including at least a translucent surface 96 arranged to pass light generated by the curvilinear LED light source 90. The stencil 92 is shaped for arrangement in the housing 94.

Figure 9:
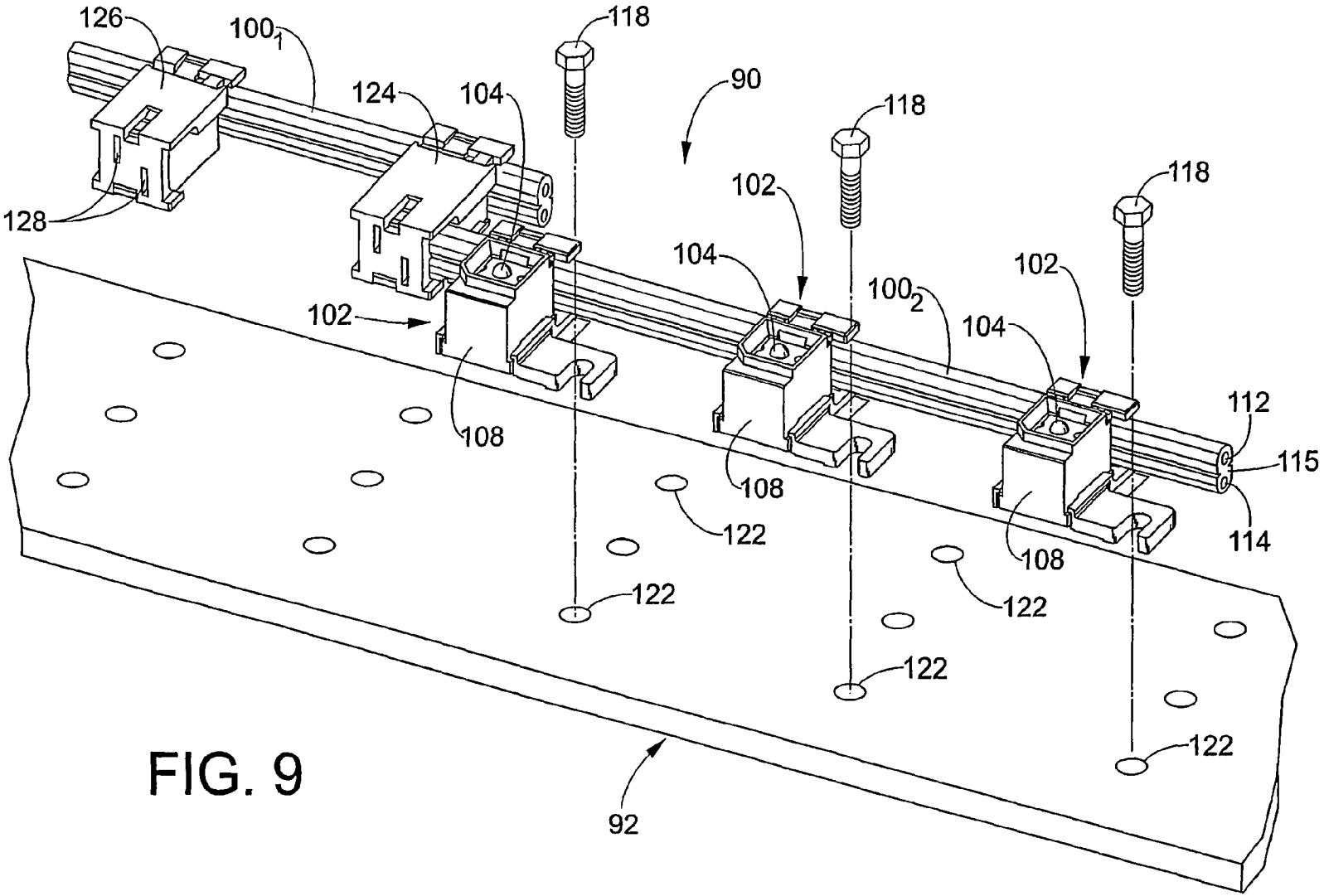
FIG. 9 illustrates a perspective view of a portion of the LED light engine of FIG. 8 and its mounting to a portion of the stencil.

With continuing reference to FIG. 8 and with further reference to FIG. 9, the flexible light engine 90 includes an insulated flexible electrical cord 100 on which a plurality of LED devices 102 are disposed in a spaced apart manner. Each LED device 102 includes an LED 104 with a lead frame which is affixed in a first region 106 of a connector 108. The connector 108 also includes a second region 110 that clamps onto the cord 100. The second region 110 includes a snap-type connector similar to that previously described with reference to FIGS. 3 and 4, and similarly serves to connect the LED 104 with parallel electrical conductors 112, 114 of the cord 100. As shown in FIG. 9, the conductors 112, 114 are maintained at an essentially constant separation by an insulating sheath 115 of the cord 100, and so the clamping connectors 108 can be placed anywhere along the cord 100.

Because the LED devices 102 are spaced apart along the flexible electrical cable 100, for example at two-inch spacings, the intervening cable portions between the LED devices 102 can bend to define a channel letter shape or other selected pattern, such as the letter "E" formed by the light engine 90 in FIG. 8. In the embodiment of FIGS. 8–16, it will be appreciated that the two parallel electrical conductors 112, 114 within the insulating sheath 115 of the cord 100 define a spatially localized cable plane containing the two conductors 112, 114. The cable 100 is bendable in a direction out of the local cable plane, whose orientation varies with the bending of the cable 100, but is relatively inflexible in the local cable plane, since bending within the local cable plane produces compressive and tensile forces along the axes of the conductors 112, 114. Hence, the cable 100 is bendable in the plane of the stencil 92 to form the light engine 90 into a pattern on the stencil 92. Note that the plane of the stencil 92 is everywhere perpendicular to the local cable plane as the cable is bent to conform with a selected lettering. It will also be recognized that the LED devices 102 are oriented such that illumination produced by the LEDs 104 is substantially directed parallel to the local cable plane, i.e. perpendicular to the plane of the stencil 92, so that the LED devices 102 produce illumination directed away from the stencil 92.

The second region 110 advantageously employs a mechanical connection which also effectuates the electrical connections of the LED 104 to the conductors 112, 114 in a manner similar to that described previously, e.g. using electrical leads 62 (see FIGS. 3 and 4) that penetrate the electrical insulation 115 of the cord 100 during the mechanical snap connection. Optionally, the second region 110 supports detachable attachment, such as an un-snapping removal of the connector 108 from the cord 100. Although such detachment can leave small openings where the insulation 115 has been displaced, the potential difference applied across the LED devices 102 in the parallel interconnection is typically low, such as a few volts corresponding to typical optimal forward voltages for commercial LEDs, and so significant safety hazards are not presented by the degraded insulation.

Figure 10:
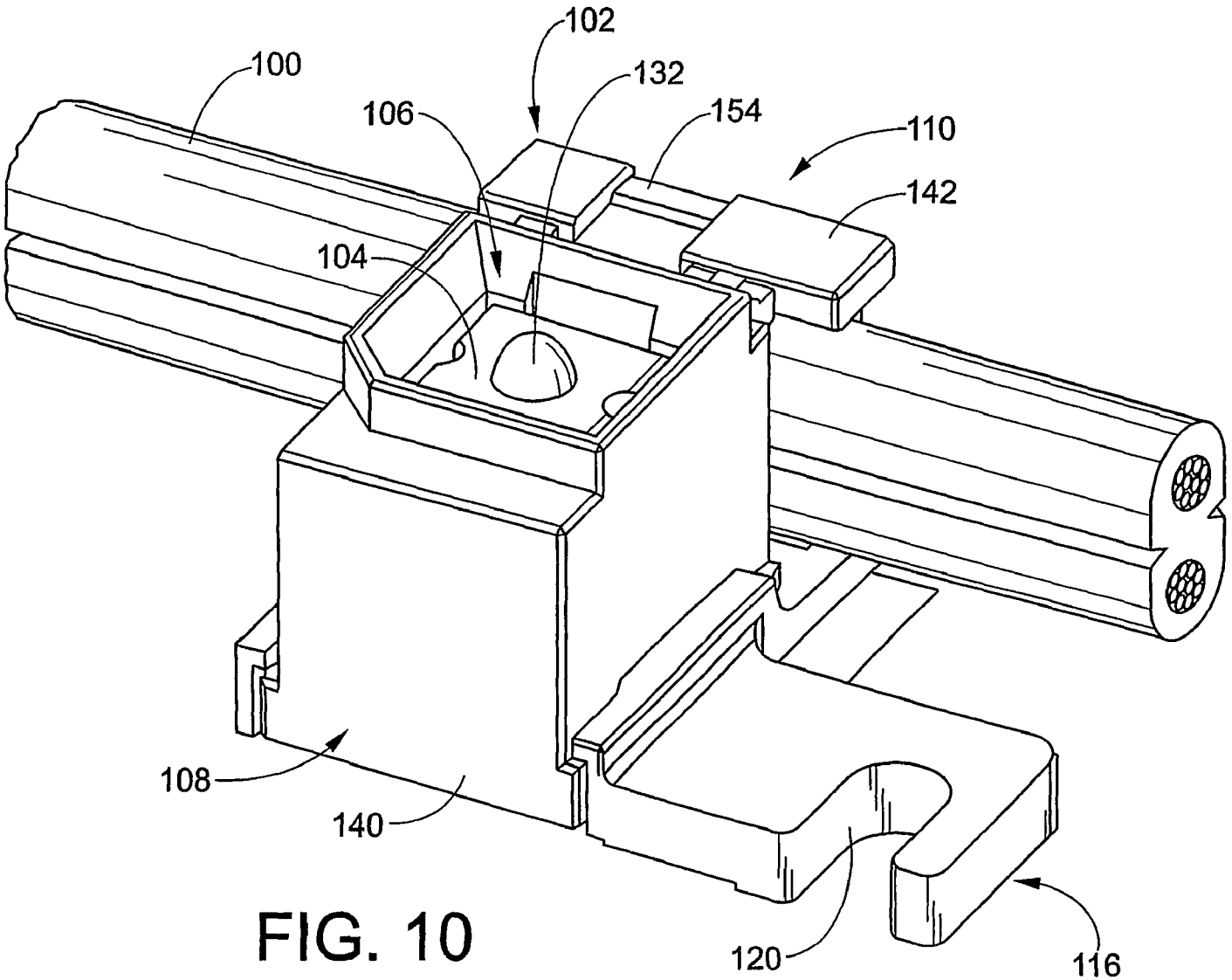
FIG. 10 illustrates an enlarged perspective view of one LED device of FIG. 9 including a snap-on connector.

With continuing reference to FIGS. 9 and 10, each connector 108 additionally includes a third region 116 adapted to cooperate with a fastener 118 for securing the connector 108 to the stencil 92. In the illustrated embodiment, the third region 116 includes a slot 120 that receives the fastener 118, which in the illustrated embodiment is an exemplary threaded screw. The fastener 118 shaft passes through the slot 120 and threads into one of a plurality of openings 122 arranged in the stencil 92.

With particular reference to FIG. 9, the cable 100 includes two lengths of cable $\mathbf{100}_1$, $\mathbf{100}_2$ that are spliced together using a snap-on splice connector 124, which is described later in greater detail with reference to FIG. 14. The splice connector electrically connects the conductors 112 of the two cables $\mathbf{100}_1$, $\mathbf{100}_2$ to form one continuous conductor, and also electrically connects the conductors 114 of the two cables $\mathbf{100}_1$, $\mathbf{100}_2$ to form another continuous conductor. The combined conductors 112, 114 are electrically isolated from one another by the insulating coating or sheath 115. Additionally, FIG. 9 shows a power connector 126 which connects with the cord 100 using the same type of snap-on clamp as is employed by the second region 110 of the connector 108. The exemplary power connector 126 includes receptacles 128 adapted to connect with prongs of a power cable connector (not shown). Although the power connector 126 is shown connected near an end of the curvilinear LED light source 90, it will be appreciated that due to the parallel electrical configuration of the source 90 the power connector 126 can instead be arranged essentially anywhere along the source 90, including between LED devices 102. Indeed, the choice of where to clamp the power connector 122 onto the curvilinear LED light source 90 is preferably determined by the geometry of the illuminated sign 88 and by the location of the driving power source (see FIG. 16). Optionally, the power connector can be integrated into a splice connector or into an LED connector.

Figure 11:
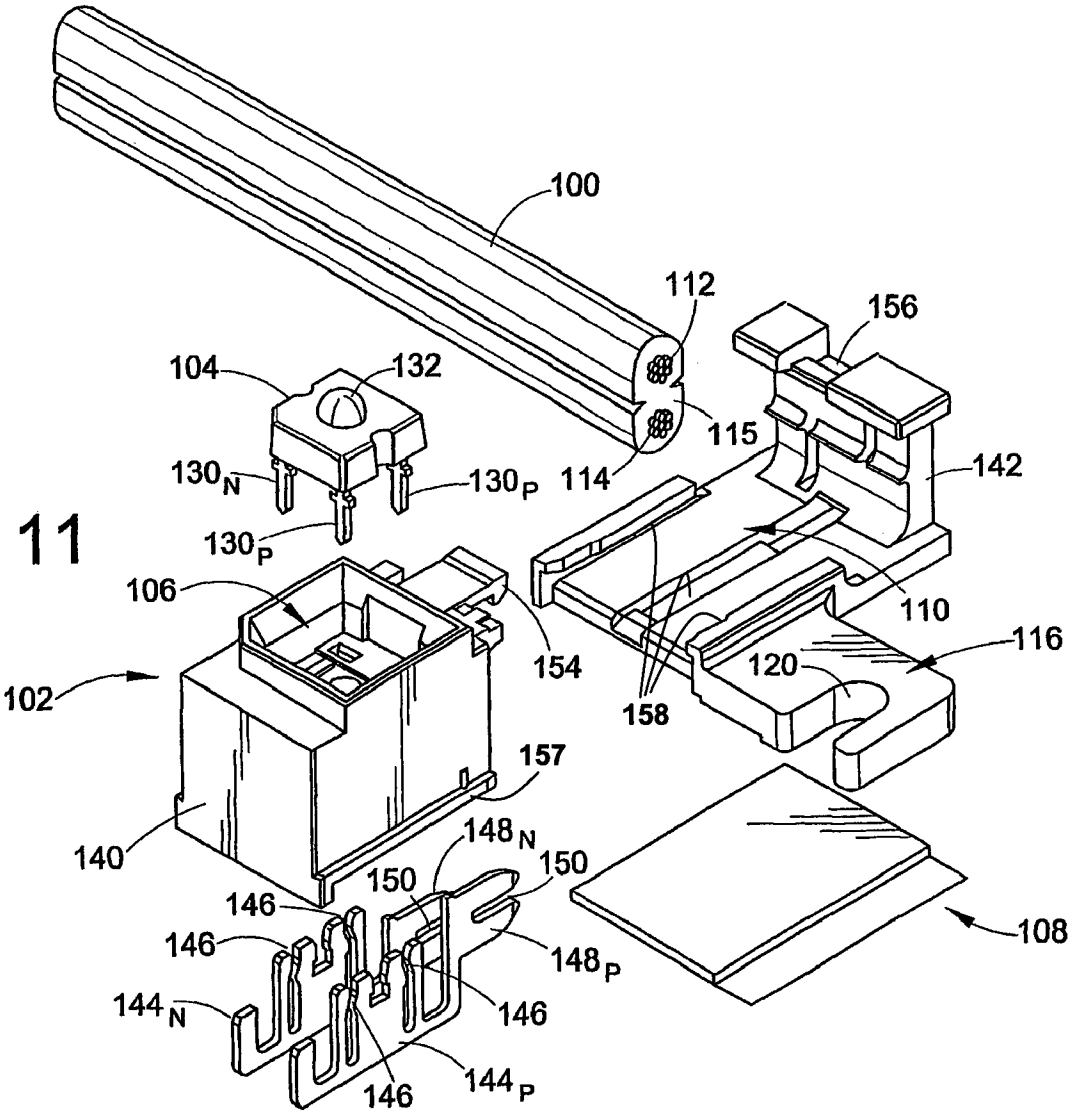
FIG. 11 illustrates an exploded perspective view of the LED device of FIG. 10.
Figure 12:
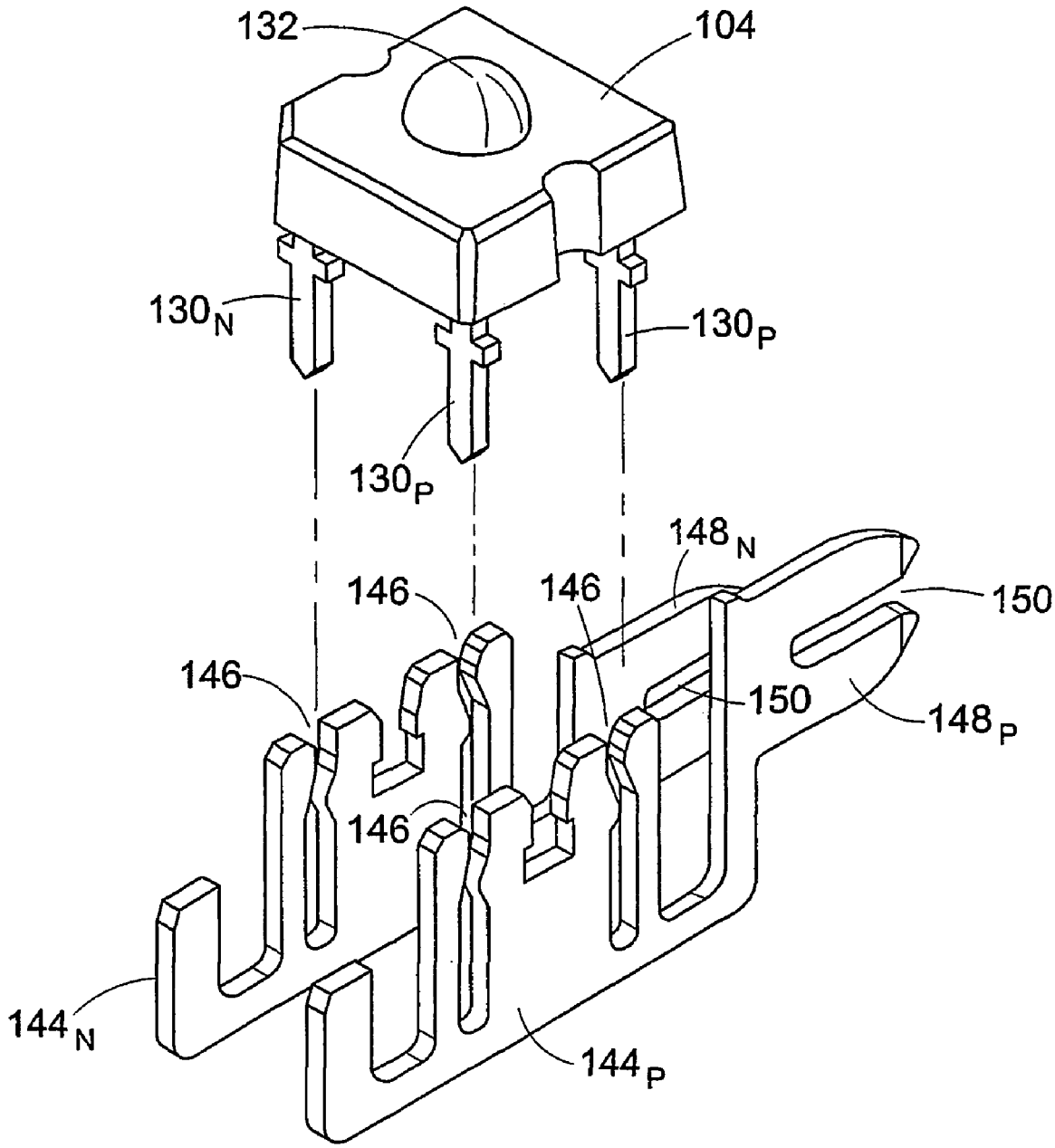
FIG. 12 illustrates the insulation-piercing members of the connector of FIGS. 10 and 11, and their interconnection with the LED leads inside the connector (connector body not shown in FIG. 12).

With particular reference to FIGS. 11 and 12, assembly of an exemplary LED device 102 is described. The LED 104 includes leads 130, specifically two positive leads $\mathbf{130}_P$ electrically communicating with the positive terminal or anode of the LED 104, and two negative leads $\mathbf{130}_N$ (one of which is blocked from view in FIGS. 11 and 12) electrically communicating with the negative terminal or cathode of the LED 104. The LED 104 also preferably includes a light-transmissive encapsulant 132 encapsulating a semiconductor chip or other electroluminescent element (not shown). The encapsulant 132 is optionally formed into a lens or other selected light-refractive shape. Furthermore, the encapsulant 132 optionally includes a phosphorescent material, a tinting, or the like that changes or adjusts the spectral output of the LED 104. Those skilled in the art will recognize that the LED 104 is substantially similar to commercially available LED packages, such as the P4 (piranha) LED package.

The first region 106 includes a socket that receives the LED 104 with the light-emitting surface (i.e., the surface with the encapsulant 132 disposed thereon) facing away from the connector 108 and the LED leads 130 inserting into the socket. The connector 108 includes a first section 140 with the first region 106 that provides the LED mount or socket, and a second section 142 that connects with the first section 140 in a clamping or snapping fashion. The second region 110 including the clamp, mechanical snap connection, or the like is defined by the connection of the two sections 140, 142 about a portion of the flexible electrical cable 100.

With continuing reference to FIGS. 11 and 12, the first section 140 also includes positive and negative conductive insulation-piercing members or prongs $\mathbf{144}_P$, $\mathbf{144}_N$ that are arranged in a substantially fixed manner in slots or openings (not shown) of the first section 140 of the connector 108. Each prong 144 is substantially planar and includes slots 146 that compressively receive the corresponding (positive or negative) LED leads 130 to effectuate electrical contact of the positive and negative terminals (anode and cathode) of the LED with the corresponding positive or negative prong $\mathbf{144}_P$, $\mathbf{144}_N$. The receiving of the LED leads 130 into the slots 146 is compressive and does not include a soldering step. Hence, it is contemplated that the LED 104 is optionally detachable from the socket region 106 of the first section 140, for example to facilitate replacement of a failed LED 104.

Assembly of the first section 140 of the connector 108 includes inserting the prongs $\mathbf{144}_P$, $\mathbf{144}_N$ into the first section 140, and inserting the LED 104 into the socket of the first region 106 so that the LED leads 130 compressively fit into the slots 146 of the prongs 144 to effectuate electrical contact therewith. In a preferred embodiment, the first section 140 is a molded body of plastic or another electrically insulating material, the prongs 144 are formed from sheet metal or another substantially planar electrically conductive material, and the LED 104 is a pre-packaged LED of a type known to the art, e.g. an electroluminescent semiconducting element arranged in a P4 (piranha) package with suitable epoxy or other encapsulant. It will be appreciated that a significant advantage of the connectorized LED device 102 is that assembly thereof involves no soldering steps.

Figure 13:
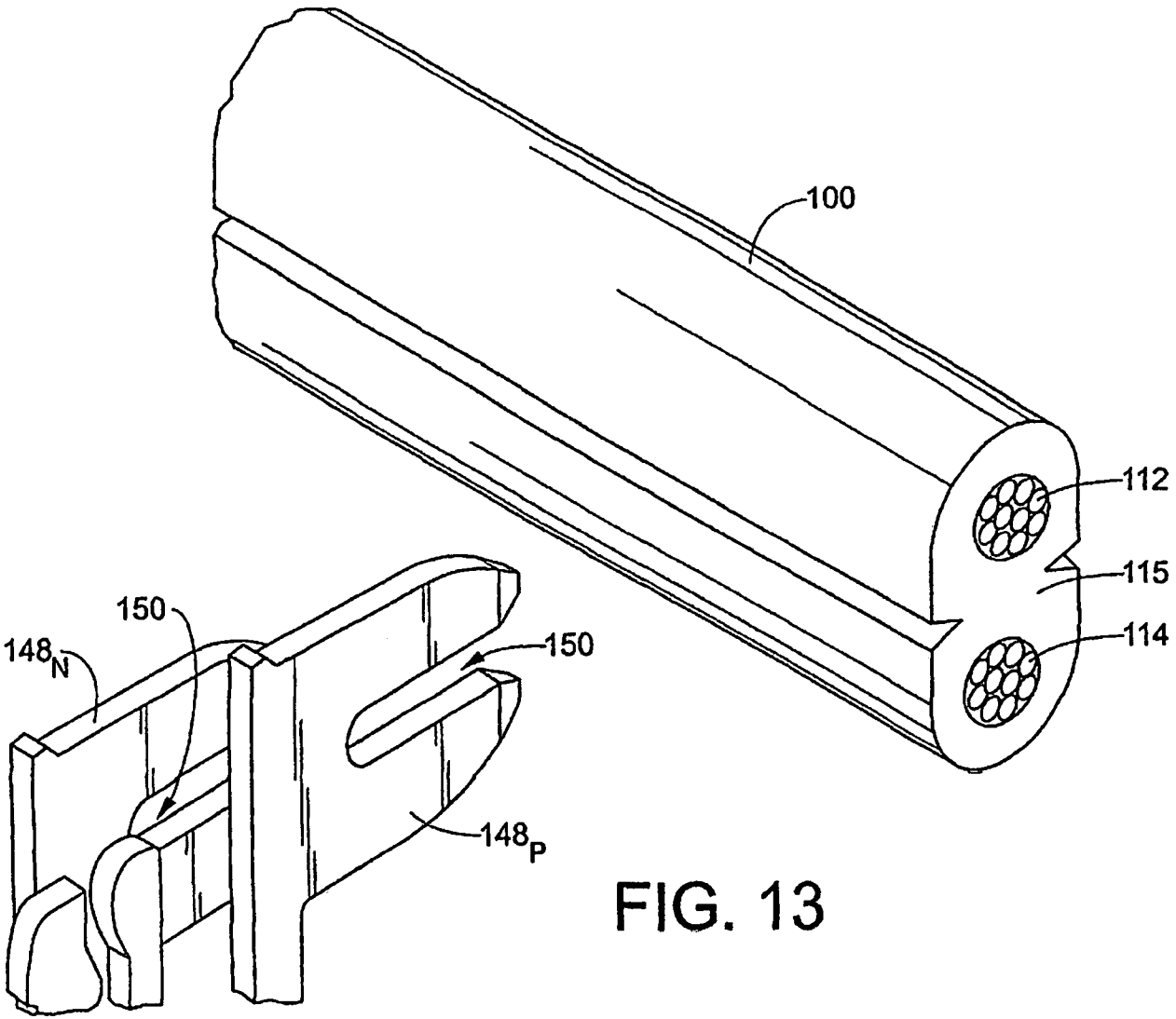
FIG. 13 illustrates the connecting of the insulation-piercing members with the conductors of the flexible electrical cable.

With continuing reference to FIGS. 11 and 12, and with further reference to FIG. 13, each prong 144 includes a "V"-shaped or bifurcated end 148 that extends out of the first section 140 toward the second section 142 such that when the first and second sections 140, 142 are clamped or snapped together with the cable 100 arranged therebetween the ends 148 of the prongs 144 puncture the cable insulation 115 and contact the conductors 112, 114. Each bifurcated end 148 defines a gap 150 sized to receive the respective conductor 112, 114 of the flexible electrical cable 100. As best seen in FIG. 13, each conductor 112, 114 is a multi-stranded conductor which compressively squeezes into the gap 150 of one of the prongs $\mathbf{144}_P$, $\mathbf{144}_N$ when the two connector sections 140, 142 are clamped or snapped about the cable 100. The compression preferably does not break or fracture the individual strands of the conductors 112, 114, but does ensure a reliable electrical contact between the prongs $\mathbf{144}_P$, $\mathbf{144}_N$ and the respective conductors 112, 114.

It will be appreciated that the snapping connection of the first and second sections 140, 142 about the cable 100 effectuates both a mechanical connection of the LED device 102 to the cable 100 as well as a simultaneous electrical connection of the positive and negative (anode and cathode) terminals of the LED 104 via the prongs $\mathbf{144}_P$, $\mathbf{144}_N$ to the conductors 112, 114 that supply electrical power. The electrical connection does not include auxiliary electrical components, such as resistors or the like, and does not include soldering. Hence the LED device 102 includes few component parts in the channel lettering which reduces the likelihood of device failure. However, it is also contemplated to include resistive or other circuit elements in the connector 108 to perform selected power conditioning or other electrical operations.

Preferably, the conductors 112, 114, the prongs $\mathbf{144}_P$, $\mathbf{144}_N$, and the LED leads 130 are formed from substantially similar metals to reduce galvanic corrosion at the electrically contacting interfaces, or are coated with a conductive coating that reduces galvanic corrosion at the interfaces. In a suitable embodiment, the conductors 112, 114, the prongs $\mathbf{144}_P$, $\mathbf{144}_N$, and the LED leads 130 are each coated with a conductive coating of the same type, which ensures that galvanic corrosion at the contacting surfaces is minimized. Particularly in the case of high power LED devices 102, embodiments that employed contacting surfaces with mismatched compositions typically experienced significant detrimental galvanic corrosion at the contacting surfaces.

With reference to FIGS. 10 and 11, the first connector section 140 includes a clip 154 that cooperates with a recess or receiving region 156 of the second connector section 142 to snappingly secure the first and second sections 140, 142 together onto the cable 100, as shown in the secured position in FIG. 10. In the embodiment illustrated in FIGS. 10 and 11, the first connector section 140 further includes features 157 that mate with grooves 158 of the second connector section 142 to define a tongue-and-groove sliding engagement. The tongue-and-groove sliding engagement facilitates correct alignment of the tips of the prongs $\mathbf{148}_P$, $\mathbf{148}_N$respective to the second connector section 142 and the cable 100 when the first and second connector sections 140, 142 are snapped together, and together with the clip 154 mating into the receiving region 156 secures the connector 108 to the cable 100 without piercing the cable except by the prongs $\mathbf{144}_P$, $\mathbf{144}_N$. Of course, other securing mechanisms can also be employed.

Figure 14:
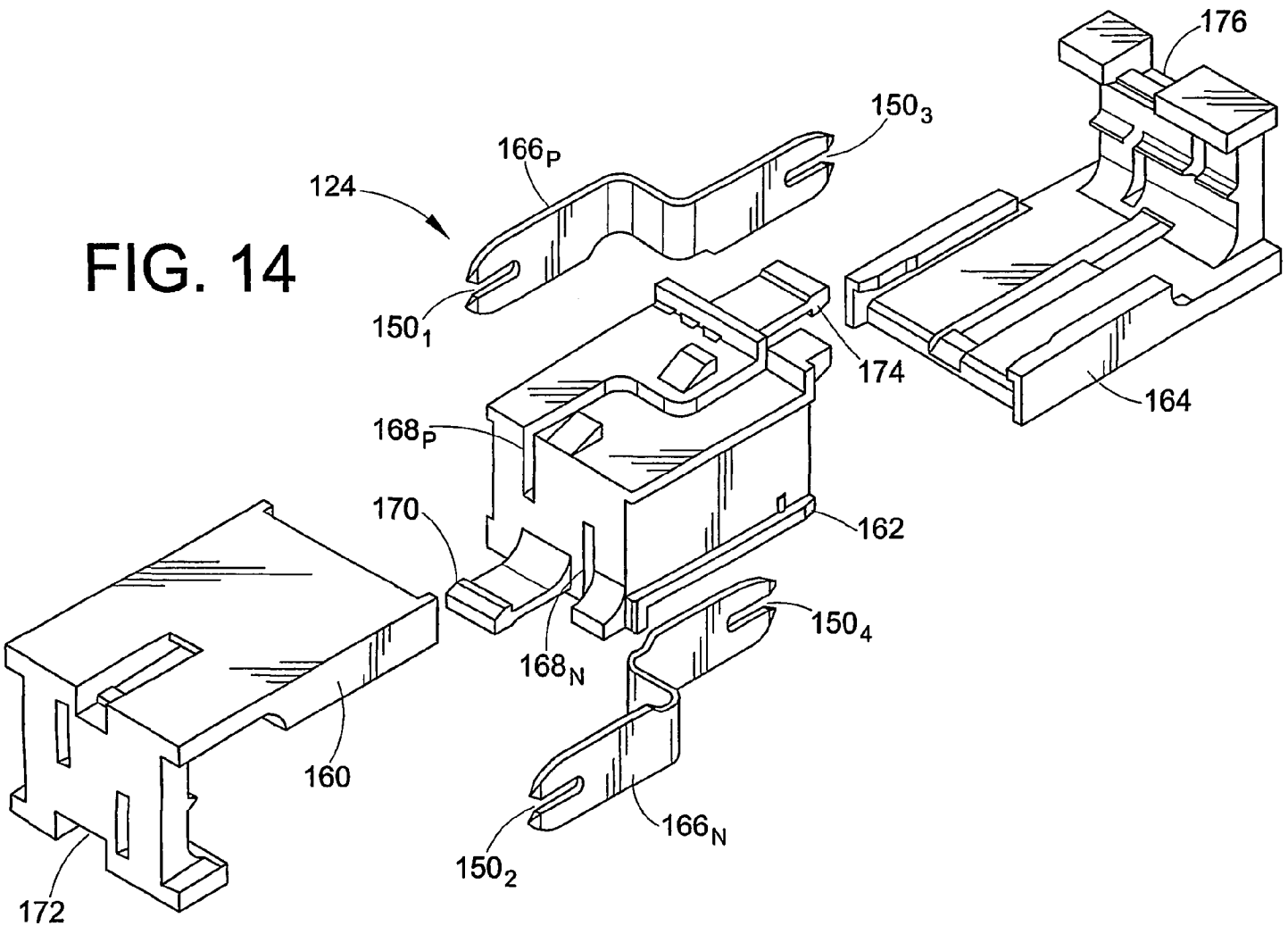
FIG. 14 illustrates an exploded view of the snap-on splice connector of FIG. 9.

With reference to FIG. 9 and with further reference to FIG. 14, the splice connector 124 employs a similar simultaneous electrical/mechanical connection of the splice connector 124 to cables $\mathbf{100}_1$, $\mathbf{100}_2$ to splice the cables $\mathbf{100}_1$, $\mathbf{100}_2$ together. The splice connector 124 includes three sections 160, 162, 164, which are preferably formed of a molded plastic or other insulating material. The section 162 is a middle section that includes positive and negative double-ended insulation-piercing elements or prongs $\mathbf{166}_P$, $\mathbf{166}_N$ that insert into slots $\mathbf{168}_P$, $\mathbf{168}_N$ of the section 162 in a substantially rigid manner similar to the inserting of the prongs $\mathbf{144}_P$, $\mathbf{144}_N$ into the section 140 of the connector 108 of the LED devices 102. The prongs $\mathbf{166}_P$, $\mathbf{166}_N$ preferably include bifurcated ends 150 as with the prongs $\mathbf{144}_P$, $\mathbf{144}_N$ of the LED devices 102, which are sized to squeeze the multi-stranded conductors 112, 114 without fracturing conductor strands.

With continuing reference to FIGS. 9 and 14, the sections 160, 162 of the splice connector 124 mechanically snap onto the flexible electrical cable $\mathbf{100}_2$. The snapping together causes the prong ends $\mathbf{150}_1$, $\mathbf{150}_2$ to pierce the insulation 115 and connect with the conductors 112, 114, respectively, of the cable $\mathbf{100}_2$. The snapping connection includes engagement of a clip 170 of the connector section 162 with a recess 172 of the connector section 160 to secure the sections 160, 162 about the cable $\mathbf{100}_2$. Similarly, the sections 162, 164 of the splice connector 124 mechanically snap onto the flexible electrical cable $\mathbf{100}_1$ with prong ends $\mathbf{150}_3$, $\mathbf{150}_4$ piercing the insulation 115 and connecting with the conductors 112, 114, respectively, of the cable $\mathbf{100}_1$. The snapping connection includes engagement of a clip 174 of the connector section 162 with a recess 176 of the connector section 164 to secure the sections 162, 164 about the cable $\mathbf{100}_1$. Hence, the prong $\mathbf{166}_P$ provides electrical connection between the conductors 112 of the cables $\mathbf{100}_1$, $\mathbf{100}_2$, while the prong $\mathbf{166}_N$ provides electrical connection between the conductors 114 of the cables $\mathbf{100}_1$, $\mathbf{100}_2$, to electrically connect the cables during the mechanical connecting of the cables $\mathbf{100}_1$, $\mathbf{100}_2$ by the splice connector 124.

Figure 15:
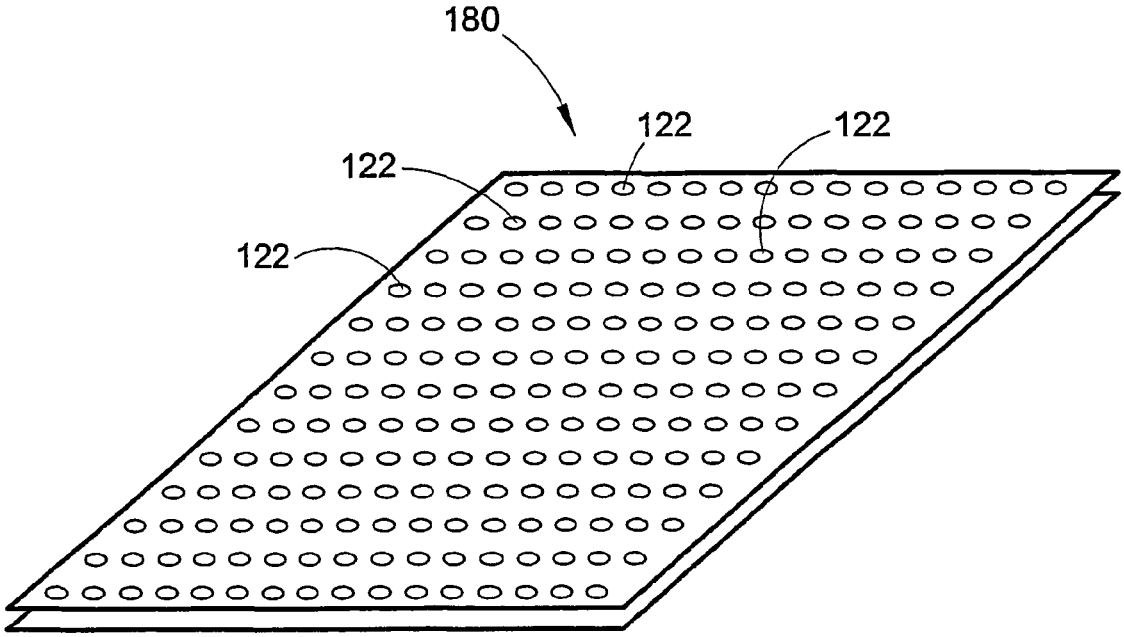
FIG. 15 illustrates a perspective view of an uncut stencil which is suitable for forming the shaped stencil of FIG. 8.

With reference to FIGS. 8 and 9 and with further reference to FIG. 15, construction of the exemplary illuminated sign 88 is advantageously modular and selectably divided between the manufacturer and the end user. In one suitable embodiment, the LEDs 104 are installed on the connectors 108 to form the LED devices 102, and the LED devices 102 are snapped onto the flexible cable 100 at the factory to form the manufactured flexible light engine 90. A stencil board 180 shown in FIG. 15 includes pre-formed openings 122, and can be cut at the installation site to match the selected letter housing 94, e.g. the stencil board 130 is cut to form the exemplary "E"-shaped stencil 92. Suitable lengths of the flexible LED light source 90 are cut off and affixed on the shaped stencil 92 using the third regions 116 of the connectors 108 and fasteners 118 applied to selected pre-formed openings 122. Splices 124 are applied as appropriate, and the power connector 126 is snapped onto the cord 100 at a selected convenient point. Optionally, the pre-formed openings 122 are omitted, and the fasteners 118 displace the stencil material to fasten thereto. For example, the displacing fasteners can be wood screws with sharp tips for engaging and penetrating the stencil material.

In a variation of the above installation process, the LEDs 104 are installed on the connectors 108 at the factory, but the LED devices 102 are snapped onto the cable 100 at selected locations along the cable 100 at the installation site. This approach is more labor-intensive at the installation site, but provides maximum flexibility in the selection and spacing of the LED devices 102 along the cord 100. Such a modular system can allow the end-user to select the colors of the LEDs 104 to create a custom multi-color flexible LED light source 90.

In yet another variation, the connector 108 is optionally omitted similarly to the previously-described embodiment of FIGS. 1 and 2, and the LED leads $\mathbf{130}_P$, $\mathbf{130}_N$ directly affixed to the cord 100. Any of the above installation/assembly processes are particularly suitable for retro-fitting an existing channel lettering. The shaped stencil 92 advantageously allows the light source 90 to be routed around or over obstructions or features such as cross-members within the existing channel letter.

Figure 16:
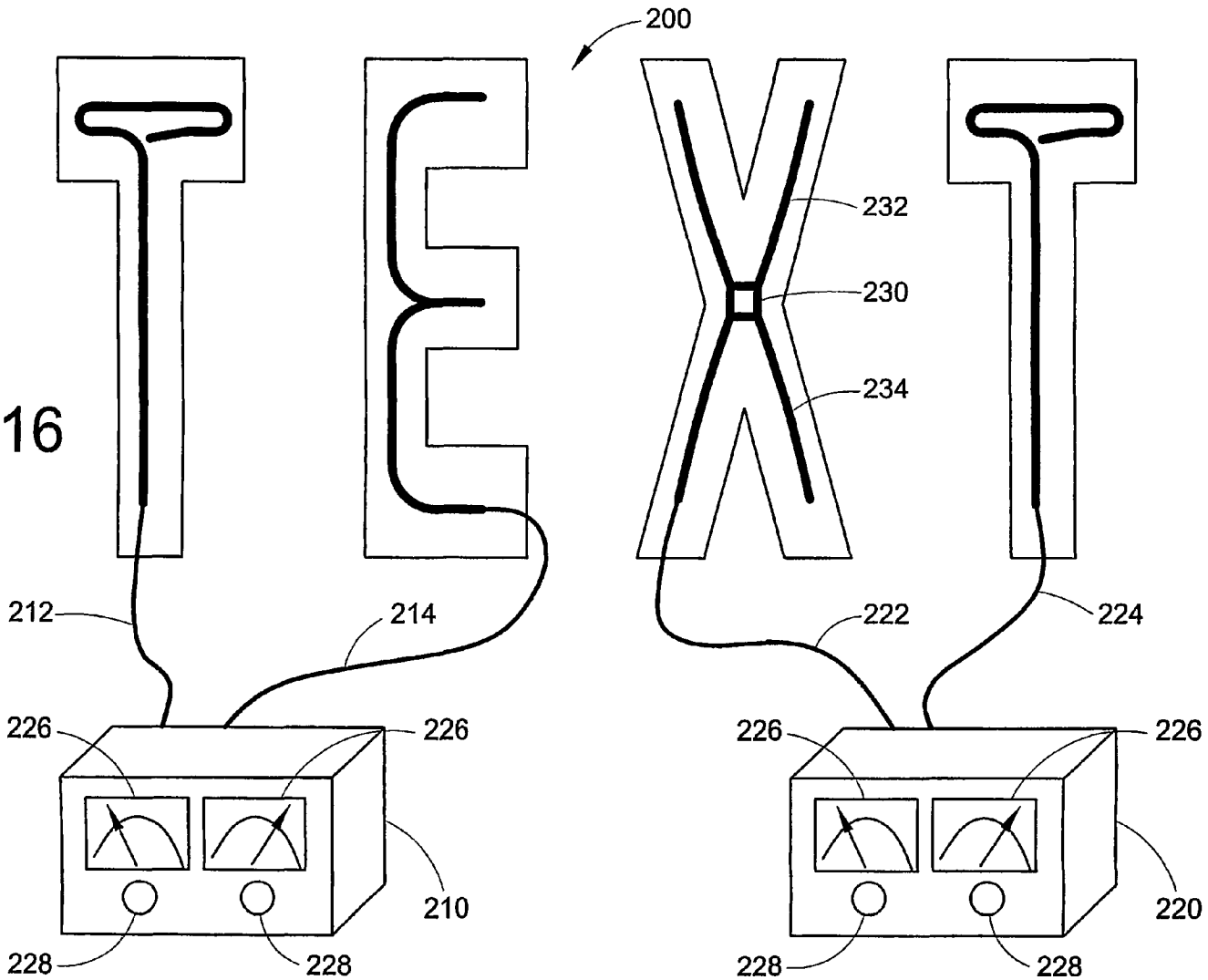
FIG. 16 illustrates a channel lettering with a suitable arrangement of independently adjustable power supply outputs.

With continuing reference to FIGS. 8–15, and with further reference to FIG. 16, a channel lettering 200 that displays "TEXT" is shown. The channel lettering portion "TE" is powered by a first power supply 210 which includes two power output lines 212, 214. The channel lettering portion "XT" is powered by a second power supply 220 which includes two power output lines 222, 224.

Each power supply 210, 220 is arranged away from the illuminated channel lettering "TEXT", for example in the interior of an associated building, and includes conditioning electronics for converting building power (e.g., 120V a.c. in the United States, or 220V a.c. in Europe) to power suitable for driving the LED light sources of the channel lettering. Since a parallel electrical connection is used in the light engine 90, the output power is low voltage, corresponding to the driving voltage of a single LED, and so a low voltage power supply can be employed. In a preferred embodiment, the power supplies 210, 220 are class II power supplies which have output power limited to 5 amperes and 30 volts. Class II power supplies are relatively safe due to the low voltages and currents produced thereby, and the output lines 212, 214, 222, 224 are typically not required by electrical codes to be arranged in safety conduits.

Of course, each power supply can include a different number of power output lines, e.g. one, three, or more power output lines. Each power output line provides a selectable electrical output power, for example as monitored by the meters 226. In a preferred embodiment, the power delivered to each power output line is individually controllable using a knob 228 or other control input. This permits balancing the light intensity of the letters, e.g. of the letters "T", "E", "X", and "T", to obtain a uniformly lit sign "TEXT".

FIG. 16 also schematically shows the use of a splice connector 230, such as the splice connector 124 of FIG. 14, to connect the upper and lower cable lengths 232, 234 of the "X" channel letter. Note that this splicing is arranged in the middle of each of the two flexible electrical cable lengths 232, 234. It will be appreciated that the splice connector can be connected substantially anywhere along the length of an electrical cable to provide great flexibility in cable arrangement.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. An illuminated sign comprising:

a channel letter housing defining at least one channel; and a flexible lighting strip secured within the channel of the channel letter housing, the flexible lighting strip including:

a flexible electrical power cord including spaced apart parallel conductors in an insulating sheath, a plurality of LEDs, and a plurality of connectors each supporting at least one LED, the connectors being spaced apart along the flexible electrical power cord and connected therewith, each connector including prongs that pierce the insulating sheath to connect with conductors of the flexible power cord to deliver electrical power from the flexible electrical power cord to the at least one LED, each connector further including first and second connector sections that are secured about a portion of the flexible electrical power cord to secure the connector thereto, the first and second connector sections including mating connector section securing features disposed on opposite sides of the flexible electrical power cord for securing the first and second connector sections about the portion of the flexible electrical power cord, the mating connector section securing features including a tongue-and-groove sliding engagement between the first and second connector sections disposed at one side of the flexible electrical power cord.

2. The illuminated sign as set forth in claim 1, wherein the prongs deliver electrical power from the flexible electrical power cord to the at least one LED via one of (i) direct connection with leads of the LED or (ii) one or more circuit elements.

3. An illuminated sign comprising:

a channel letter housing defining at least one channel; and a flexible lighting strip secured within the channel of the channel letter housing, the flexible lighting strip including:

a flexible electrical power cord including spaced apart parallel conductors in an insulating sheath, the spaced apart parallel conductors in the insulating sheath defining a cord plane arranged transverse to a surface of the channel to which the flexible lighting strip is secured, a plurality of LEDs, and a plurality of connectors each supporting at least one LED, the connectors being spaced apart along the flexible electrical power cord and connected therewith, each connector including prongs that pierce the insulating sheath to connect with conductors of the flexible power cord to deliver electrical power from the flexible electrical power cord to the at least one LED.

4. The illuminated sign as set forth in claim 3, further comprising:

a stencil conforming with the at least one channel of the channel letter housing and secured within the at least one channel, the flexible lighting strip being secured to the stencil.

5. The illuminated sign as set forth in claim 4, wherein each connector includes:

a bracket by which the connector is secured to the stencil.

6. The illuminated sign as set forth in claim 3, wherein each connector of the flexible lighting strip comprises:

first and second connector sections that are secured about a portion of the flexible electrical power cord to secure the connector thereto.

7. The illuminated sign as set forth in claim 6, wherein the first and second connector sections comprise:

mating connector section securing features disposed on opposite sides of the flexible electrical power cord for securing the first and second connector sections about the portion of the flexible electrical power cord.

8. The illuminated sign as set forth in claim 7, wherein the mating connector section securing features comprise:

a clip disposed on the first connector section at one side of the flexible electrical power cord that mates with a receiving region of the second connector section at the same side of the flexible electrical power cord.

9. The illuminated sign as set forth in claim 3, wherein each connector of the flexible lighting strip comprises:

first and second connector sections that are secured about a portion of the flexible electrical power cord to secure the connector thereto, the at least one LED being supported on one of the first and second connector sections in a position outside of the cord plane.

10. The illuminated sign as set forth in claim 3, wherein the connectors do not pierce the flexible lighting strip except via the prongs.

11. The illuminated sign as set forth in claim 3, wherein the conductors of the flexible power cord do not include electrical discontinuities.

12. The illuminated sign as set forth in claim 3, wherein the at least one LED supported by each connector is arranged on the connector spatially offset from the cord plane.

13. The illuminated sign as set forth in claim 3, further comprising:

a power supply disposed outside of the channel letter housing for delivering power to the flexible electrical power cord of the flexible lighting strip.

14. The illuminated sign as set forth in claim 13, wherein the power supply is a class II power supply.

15. The illuminated sign as set forth in claim 3, wherein the prongs deliver electrical power from the flexible electrical power cord to the at least one LED via one of (i) direct connection with leads of the LED or (ii) one or more circuit elements.

16. The illuminated sign as set forth in claim 3, wherein each prong has a bifurcated tip that receives one of the parallel conductors of the flexible electrical power cord.

17. The illuminated sign as set forth in claim 3, wherein interfacing surfaces of the parallel conductors and the prongs are made of substantially similar metals to reduce galvanic corrosion.

18. The illuminated sign as set forth in claim 3, wherein interfacing surfaces of the parallel conductors and the prongs include a conductive coating that reduces galvanic corrosion at the interfaces.

19. An illuminated sign comprising:

a channel letter housing defining at least one channel;

a flexible lighting strip secured within the channel of the channel letter housing, the flexible lighting strip including:

a flexible lighting strip including at least two strip branches defined by two flexible electrical power cords each including spaced apart parallel conductors in an insulating sheath, a plurality of LEDs, and a plurality of connectors each supporting at least one LED, the connectors being spaced apart along the flexible electrical power cord and connected therewith, each connector including prongs that pierce the insulating sheath to connect with conductors of the flexible power cord to deliver electrical power from the flexible electrical power cord to the at least one LED;

a power supply disposed outside of the channel letter housing for delivering power to the flexible lighting strip; and a splice connector electrically connecting the two flexible electrical power cords of the flexible lighting strip.

20. The illuminated sign as set forth in claim 19, wherein one of the two flexible electrical power cords is electrically connected with the power supply, and the other of the two flexible electrical power cords receives electrical power from the splice connector.

21. The illuminated sign as set forth in claim 19, wherein the power supply electrically connects with the splice connector to deliver electrical power to the two flexible electrical power cords.

22. An illuminated sign comprising:

a channel letter housing defining at least one channel;

a flexible lighting strip secured within the channel of the channel letter housing, the flexible lighting strip including:

a flexible electrical power cord including spaced apart parallel conductors in an insulating sheath, a plurality of LEDs, and a plurality of connectors each supporting at least one LED, the connectors being spaced apart along the flexible electrical power cord and connected therewith, each connector including prongs that pierce the insulating sheath to connect with conductors of the flexible power cord to deliver electrical power from the flexible electrical power cord to the at least one LED;

a power supply disposed outside of the channel letter housing for delivering power to the flexible electrical power cord of the flexible lighting strip; and a power connector by which the power supply is connected with the flexible electrical power cord, the power connector being arranged between two of the connectors that are spaced apart along the flexible electrical power cord.

23. An illuminated sign comprising:

a channel letter housing defining at least one channel;

a flexible lighting strip secured within the channel of the channel letter housing, the flexible lighting strip including:

a flexible electrical power cord including two or more ends and including spaced apart parallel conductors in an insulating sheath, a plurality of LEDs, and a plurality of connectors each supporting at least one LED, the connectors being spaced apart along the flexible electrical power cord and connected therewith, each connector including prongs that pierce the insulating sheath to connect with conductors of the flexible power cord to deliver electrical power from the flexible electrical power cord to the at least one LED;

a power supply disposed outside of the channel letter housing for delivering power to the flexible electrical power cord of the flexible lighting strip; and a power connector by which the power supply is connected with the flexible electrical power cord, the power connector being connected with the flexible electrical power cord at a point away from any of the two or more ends of the flexible electrical power cord.

24. An illuminated sign comprising:

a channel letter housing defining at least one channel; and a flexible lighting strip secured within the channel of the channel letter housing, the flexible lighting strip including:

a flexible electrical power cord including spaced apart parallel conductors in an insulating sheath, a plurality of LEDs, and a plurality of connectors each supporting at least one LED, the connectors being spaced apart along the flexible electrical power cord and connected therewith, each connector including prongs that pierce the insulating sheath to connect with conductors of the flexible power cord to deliver electrical power from the flexible electrical power cord to the at least one LED, each prong having a bifurcated tip that receives one of the parallel conductors of the flexible electrical power cord, the parallel conductors being multi-stranded conductors that are compressively held within the bifurcated ends of the prongs.

25. The illuminated sign as set forth in claim 24, wherein each connector of the flexible lighting strip comprises:

first and second connector sections that are secured about a portion of the flexible electrical power cord to secure the connector thereto.

26. The illuminated sign as set forth in claim 25, wherein the first and second connector sections comprise:

mating connector section securing features disposed on opposite sides of the flexible electrical power cord, for securing the first and second connector sections about the portion of the flexible electrical power cord.

27. The illuminated sign as set forth in claim 24, wherein the connectors do not pierce the flexible lighting strip except via the prongs.

28. The illuminated sign as set forth in claim 24, wherein the conductors of the flexible power cord do not include electrical discontinuities.

29. The illuminated sign as set forth in claim 24, wherein the at least one LED supported by each connector is arranged on the connector spatially offset from the cord plane.

30. The illuminated sign as set forth in claim 24, wherein the prongs deliver electrical power from the flexible electrical power cord to the at least one LED via one of (i) direct connection with leads of the LED or (ii) one or more circuit elements.

31. The illuminated sign as set forth in claim 24, wherein interfacing surfaces of the parallel conductors and the prongs are made of substantially similar metals to reduce galvanic corrosion.

32. The illuminated sign as set forth in claim 24, wherein interfacing surfaces of the parallel conductors and the prongs include a conductive coating that reduces galvanic corrosion at the interfaces.

33. An illuminated sign comprising:

a channel letter housing defining at least one channel at least a portion of which is curved; and a flexible lighting strip secured within the channel of the channel letter housing, at least a portion of the flexible lighting strip being secured in a curved configuration conforming with the at least one curved channel portion, the flexible lighting strip including:

a flexible electrical power cord including spaced apart parallel conductors in an insulating sheath, the spaced apart parallel conductors in the insulating sheath defining a cord plane arranged transverse to a surface of the channel to which the flexible lighting strip is secured, a plurality of LEDs, and a plurality of connectors each supporting at least one LED, the connectors being spaced apart along the flexible electrical power cord and connected therewith, each connector including prongs that pierce the insulating sheath to connect with conductors of the flexible power cord to deliver electrical power from the flexible electrical power cord to the at least one LED.

34. The illuminated sign as set forth in claim 33, wherein each connector of the flexible lighting strip comprises:

first and second connector sections that are secured about a portion of the flexible electrical power cord to secure the connector thereto.

35. The illuminated sign as set forth in claim 34, wherein the first and second connector sections comprise:

mating connector section securing features disposed on opposite sides of the flexible electrical power cord for securing the first and second connector sections about the portion of the flexible electrical power cord.

36. The illuminated sign as set forth in claim 33, wherein the connectors do not pierce the flexible lighting strip except via the prongs.

37. The illuminated sign as set forth in claim 33, wherein the conductors of the flexible power cord do not include electrical discontinuities.

38. The illuminated sign as set forth in claim 33, wherein the at least one LED supported by each connector is arranged on the connector spatially offset from the cord plane.

39. The illuminated sign as set forth in claim 33, wherein the prongs deliver electrical power from the flexible electrical power cord to the at least one LED via one of (i) direct connection with leads of the LED or (ii) one or more circuit elements.

40. The illuminated sign as set forth in claim 33, wherein interfacing surfaces of the parallel conductors and the prongs are made of substantially similar metals to reduce galvanic corrosion.

41. The illuminated sign as set forth in claim 33, wherein interfacing surfaces of the parallel conductors and the prongs include a conductive coating that reduces galvanic corrosion at the interfaces.

* * * * *